US005168921A

United States Patent [19]

Meyer, IV

[11] Patent Number: 5,168,921

[45] Date of Patent: Dec. 8, 1992

[54] COOLING PLATE WITH INTERNAL EXPANDABLE HEAT PIPE

[75] Inventor: George A. Meyer, IV, Conestoga, Pa.

[73] Assignee: Thermacore, Inc., Lancaster, Pa.

[21] Appl. No.: 813,901

[22] Filed: Dec. 23, 1991

[51] Int. Cl.[5] ..... F23D 15/02

[52] U.S. Cl. ..... 165/104.14; 165/104.26; 165/46; 165/104.33; 29/890.032

[58] Field of Search ..... 165/32, 46, 104.14, 165/104.26; 29/890.032

[56] References Cited

U.S. PATENT DOCUMENTS

| | | | |
|---|---|---|---|
| 3,152,774 | 10/1964 | Wyatt . | |
| 3,429,122 | 2/1969 | Pravda et al. . | |
| 3,490,718 | 1/1970 | Vary | 165/104.26 |
| 3,738,702 | 6/1973 | Jacobs . | |
| 3,749,156 | 7/1973 | Fletcher et al. . | |
| 3,834,457 | 9/1974 | Madsen . | |
| 3,957,107 | 5/1976 | Altoz | 165/32 |
| 4,212,347 | 7/1980 | Eastman | 165/104.26 |
| 4,279,294 | 7/1981 | Fitzpatrick et al. | 165/104.26 |
| 4,454,910 | 6/1984 | Miyazaki | 165/32 |
| 4,848,445 | 7/1989 | Harper | 165/46 |
| 4,880,052 | 11/1989 | Meyer, IV et al. | 165/104.14 |
| 4,938,279 | 7/1990 | Betker | 165/46 |
| 4,971,138 | 11/1990 | Lowenstein | 165/46 |

FOREIGN PATENT DOCUMENTS

| | | | |
|---|---|---|---|
| 1402789 | 6/1988 | U.S.S.R. | 165/46 |

*Primary Examiner*—Albert W. Davis, Jr.
*Attorney, Agent, or Firm*—Martin Fruitman

[57] ABSTRACT

A heat pipe cooling plate in which one or more heat pipes sandwiched between cover plates is an expandable heat pipe made with thin flexible walls forming the heat pipe casing. One advantage of such an expandable heat pipe within the cooling plate structure is that the heat pipe need not be bonded to the outer casing. Instead, the heat pipe balloons out when the vapor pressure increases upon heating, and the flexible heat pipe casing moves into intimate contact with the boundary surfaces of the cooling plate.

5 Claims, 2 Drawing Sheets

COOLING PLATE WITH INTERNAL EXPANDABLE HEAT PIPE

SUMMARY OF THE INVENTION

This invention deals generally with heat transfer and more specifically with a cooling plate assembly constructed with an internal heat pipe.

Thin cooling plates can be useful subassemblies for many heat transfer applications. They are used to transfer heat from one edge to another, from one face to the opposite face, or from one face to an edge. One of the simplest forms of a cooling plate is the simple copper sheet which isolates two fluids and transfers heat across its thickness.

However, for heat transfer from edge to edge of a plate or from a face to an edge, simple sheets of heat conductive material are not the most satisfactory configuration. The very structure of a thin plate counteracts effective heat transfer when the heat must be transferred in a direction parallel to the plane of the plate. In that direction, the small cross section area and the long length of path create a high resistance to heat flow.

For heat flow in situations which require transfer of heat in a direction parallel to the larger surfaces of plates, it has been found advantageous to use heat pipes within a cooling plate assembly.

U.S. Pat. Nos. 3,450,195 to Schnacke, 4,118,756 to Nelson et al and 4,880,052 to Meyer et al all show cooling plate assemblies which include heat pipes. Schnacke forms the plate from identical individual heat pipes which are assembled adjacent to each other to form the panel. Nelson et al built a single heat pipe in the form of a plate and included multiple interconnected branches. Meyer et al discloses a plate with multiple chambers, each containing a heat pipe which is bonded to the two flat cover plates.

Each of these devices has its own problems. The assembly of multiple individual heat pipes, whether made from a single sheet surface and compartmentalized or made from individual heat pipes which are attached to each other or placed within prepared cavities, is expensive and complex. The individual heat pipes must be constructed to close tolerances so that they will fit together or within prescribed compartments, and if a truly flat surface is required, tolerance and assembly problems are aggravated.

The single heat pipe with multiple branches has similar cost and tolerance problems, and also adds problems of its own. The construction with interconnected branches means that if any one branch fails, it destroys the entire assembly. This generally leads to the use of thicker walls to assure structural integrity, but a weak assembly joint can still cause a catastrophic failure. Moreover, when as in Nelson et al, the entire periphery of the assembly has a joint which is subject to the vapor pressure of the heat pipe, the chances of failure are increased.

Problems from the requirements of close tolerances and leak tight assemblies have tended to limit heat pipe cooling plates to applications which have no other alternatives, such as space applications, where other considerations such as light weight counteract the higher cost of extra testing for reliability. Moreover, in most of the previous designs, the heat pipes can not be tested until the entire assembly is completed, which means a failure is far more costly than if the heat pipes can be tested individually before final assembly.

The present invention offers a solution to the high cost and low reliability of the prior art cooling plates, because it uses pre-assembled, pre-tested individual heat pipes which are assembled into the cooling plate only after their integrity has been assured. Furthermore, the assembly of the invention require no bonding of the heat pipes to the cover plates of the cooling plate and therefore poses no risk of damaging the pre-tested heat pipes during such bonding.

The present invention is essentially a cooling plate constructed with two cover plates, usually parallel but not required to be so, bonded to a spacer configuration which separates the cover plates. The finished cover plate has the general appearance of a very shallow metal box with both its cover plates permanently bonded to its sides so that it is completely sealed.

Enclosed within this sealed box are one or more heat pipes, and each heat pipe within the cooling plate is constructed with a flexible, expandable, casing. Such a heat pipe will expand when the temperature to which it is subjected raises the vapor pressure within the heat pipe casing. For the structure of the present invention the flexible casing is sized so that, when it expands, it moves into intimate contact with the inside surfaces of the cover plates, and possibly the sides and ends, of the cooling plate.

This structure of an expanding heat pipe within a rigid, hollow plate permits the heat pipe to transfer heat within the cooling plate in the same manner, and just as effectively as a heat pipe which is permanently bonded to the cover plates and sides of the cooling plate. However, since the heat pipe need not actually be bonded to the covers, ends and sides of the cooling plate there is no risk of damage to the heat pipe during the bonding operation.

The minimal risk of damage to the heat pipe therefore permits a reduction of the number of heat pipes used within the cooling plate, since a major reason for multiple smaller heat pipes within such a structure is the redundancy afforded by a larger number of heat pipes. As the number of heat pipes in the cooling plate increases, the failure of one such heat pipe during assembly of the cooling plate becomes less significant.

However, by the use of the present invention, for which failure of a heat pipe during assembly of the cooling plate is virtually eliminated, it is quite practical to use only one heat pipe inside a cooling plate. Such an assembly is far simpler and much less expensive than the previous structures, because, when a single heat pipe can be used in the present invention, it not only eliminates the need for a multiple compartment spacer between the cover plates, but it dramatically reduces the total cost of the heat pipes within the cooling plate. It is clearly much less expensive to construct and test one expandable casing heat pipe than to construct and test several rigid casing heat pipes.

Another important advantage of the present invention is the elimination of the need to match the coefficient of thermal expansion of the internal heat pipes to the coefficient of thermal expansion of the cooling plate surface materials. Since the heat pipes are not attached to the surfaces of the cooling plate there is no requirement for matching the thermal expansions to reduce stress. This removes a severe limitation on the construction of the cooling plate, because the materials used for the external surfaces of the cooling plate are frequently determined by the application for which the cooling plate is to be used, while the heat pipe materials should be selected for their heat transfer characteristics and their compatibility with the heat transfer fluid within the heat pipe.

In the prior art cooling plates these goals frequently had to be compromised in order to satisfy the thermal expansion matching requirement, but in the present invention these choices of material can be optimized for their individual requirements, since there is no attachment of the heat pipe to the cooling plate surfaces, and no need to match thermal expansion.

The present invention, therefore furnishes a highly reliable cooling plate with one or more internal heat pipes, and does so with a simpler and less expensive structure.

DETAILED DESCRIPTION OF THE INVENTION

Figure 1:
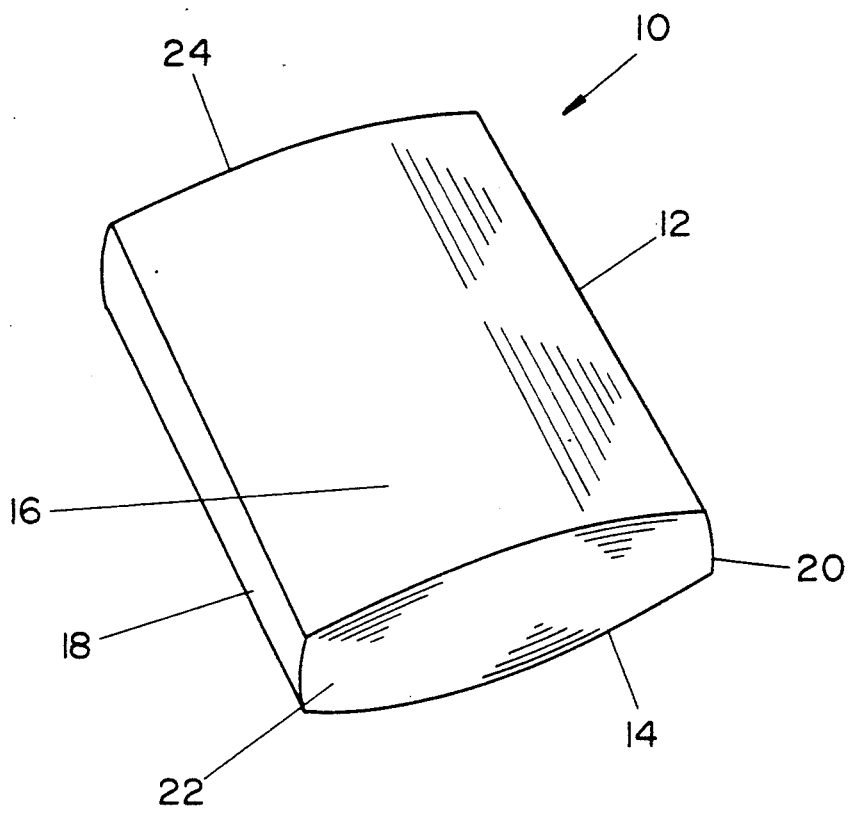
FIG. 1 is a perspective view of the preferred embodiment of the expandable heat pipe used in the present invention.

FIG. 1 is a perspective view of heat pipe 10 of the preferred embodiment of the invention. FIG. 1 shows the very simple construction of heat pipe 10 which is an essential component of the invention.

Heat pipe 10 is a conventional heat pipe in all respects other than the structure of casing 12. Heat pipe 10 may include any of the conventional internal structures for a heat pipe, that is, it may have conventional internal wick structures or arteries to move condensed liquid. Heat pipe 10 also, of course, must include a vaporizable heat transfer fluid and a vapor transport system, such as an open space which permits vapor to move from the region operating as the evaporator to the region operating as the condenser of the heat pipe.

The key feature of heat pipe 10 is the flexibility and expandability of casing 12. Casing 12 is constructed of at least two surfaces, bottom sheet 14 and top sheet 16, made of flexible sheet material which will collapse if the pressure external to heat pipe 10 is greater than the internal pressure. If, however, the internal pressure is greater than the external pressure, casing 12 will expand, and sheets 14 and 16 will separate.

Figure 2:
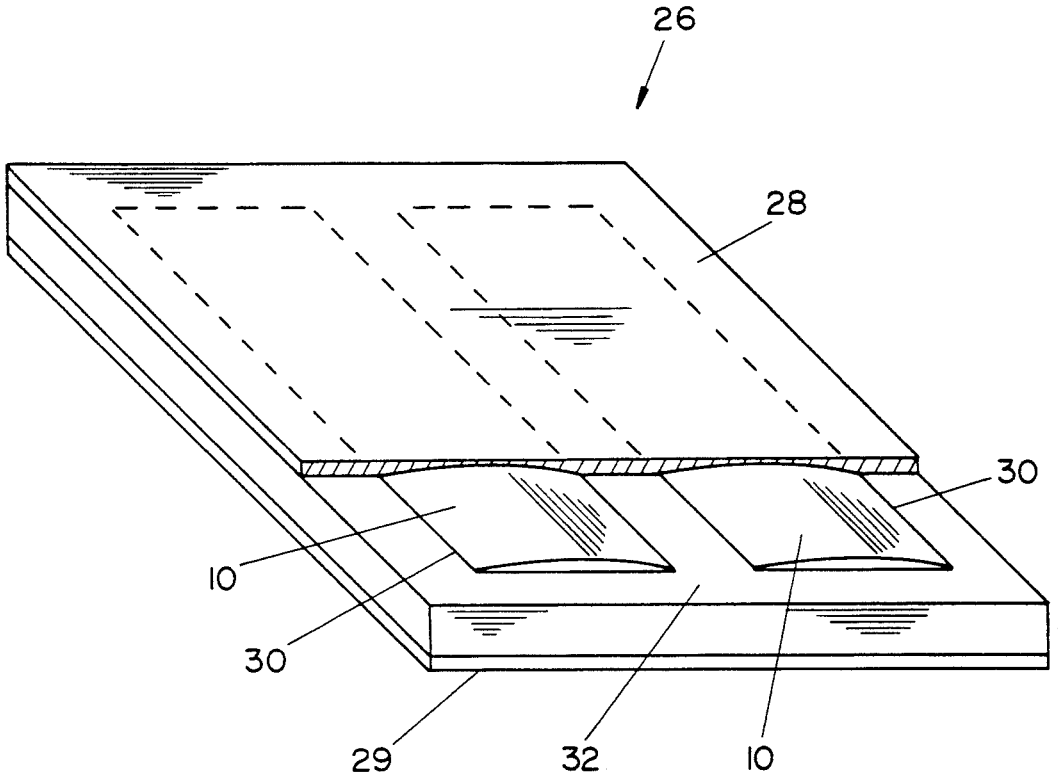
FIG. 2 is a perspective view of one embodiment of the heat pipe cooling plate of the invention with one cover plate partially cut away.

In FIG. 1, casing 12 of heat pipe 10 is shown fully expanded, a condition that will not normally occur when heat pipe 10 is installed within a cooling plate, as pictured in FIG. 2, because the expansion will be resisted when heat pipe 10 contacts the rigid sides of the cooling plate.

FIG. 1 also depicts casing 12 as including relatively distinct side panels 18 and 20 and end panels 22 and 24. Such side panels and end panels may not be required if casing 12 has a very limited height, or if heat pipe 10 is not required to transfer heat from or to the regions of casing 12 near the edges of bottom sheet 14 and top sheet 16. In such circumstances of no heat transfer from the edge regions or of a very thin cooling plate, the edges of lower panel 14 and upper panel 16 may be bonded to each other along their adjacent edges, and the side and end panels eliminated.

It should be appreciated that the expansion of casing 12, being dependent on the vapor pressure within casing 12, is a function of the temperature to which heat pipe 10 is subjected. If heat pipe 10 is cool enough, the fluid within casing 12 will not vaporize to a significant extent, and the vapor pressure within casing 12 will be less than the external pressure, causing casing 12 to collapse. Also, when heat pipe 10 is in use and subjected to heat, it will expand when the internal vapor pressure surpasses the pressure external to the heat pipe.

FIG. 2 is a perspective view of one embodiment of the invention in which cooling plate 26 is shown with top cover plate 28 and similar bottom plate 29 bonded to spacer plate 32. Top cover plate 28 is shown partially cut away so that the very simple internal structure of cooling plate 26 can be viewed.

In FIG. 2 heat pipes 10 are located within slots 30 of spacer plate 32. Spacer plate 32 forms the low height sides and ends of cooling plate 26 and can contain any number of slots 30. Expandable heat pipes 10 are constructed of sizes and configurations to essentially fill slots 30 when heat pipes 10 are expanded by their internal vapor pressure being greater than the pressure external to the heat pipes.

The vaporizable fluid within heat pipes 10 is chosen so that its vapor pressure will be greater than the pressure external to heat pipes 10 when heat pipes 10 are at their normal operating temperature. Thus, under typical conditions, the vapor pressure must be greater than atmospheric pressure when the heat pipes are required to transfer heat. However, if a partial vacuum is maintained in slots 30 by evacuating them during assembly of cooling plate 26, the vapor pressure can be selected to be virtually any pressure.

This simple structure of cooling plate 26, which is based upon the expandability of heat pipes 10, furnishes a highly reliable yet inexpensive means of cooling other devices. Typically, devices such as semiconductors can be attached along the entire surface of top cover 28 and a cooling means, such as a water cooling pipe, can be attached to cooling plate 26 along one edge of top cover 28 or bottom cover 29. The action of heat pipes 10 after they have expanded to put their casings in intimate contact with top plate 28, bottom plate 29 and spacer plate 32 will then maintain the semiconductors at virtually the same temperature as that of the water cooling pipe.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, cooling plate 26 may have a different configuration, such as circular, or may be curved so that it is not in a single plane. Similarly, heat pipes 10 and slots 30 could also be of a different shapes.

What is claimed as new and for which Letters Patent of the United States are desired to be secured is:

1. A cooling plate comprising:

a first surface sheet;

a second surface sheet;

a heat conductive spacer means attached to the first surface sheet and to the second surface sheet to form a sealed enclosure, the boundaries of the enclosure being formed by the first surface sheet, the second surface sheet and the spacer means;

a heat pipe located within the enclosure, the heat pipe having an expandable casing which is constructed so that all its surfaces are flexible sheets, and including an internal capillary means to transfer liquid from its condenser region to its evaporator region and a vaporizable fluid within the casing, all surfaces of the casing flexing and expanding when the vapor pressure of the fluid within the casing is greater than the pressure external to the casing, and the casing being located within the enclosure so that when the casing is expanded it is in contact with at least one surface of the enclosure.

2. The cooling plate of claim 1 wherein the first surface sheet and the second surface sheet are parallel.

3. The cooling plate of claim 1 wherein the casing is in its expanded condition when the heat pipe is at its operating temperature.

4. The cooling plate of claim 1 wherein the heat pipe casing comprises two flexible sheets sealed together at their edges.

5. The cooling plate of claim 1 wherein the heat pipe casing comprises two flexible sheets attached together by flexible side and end panels to form a casing in which all of the boundary surfaces are expandable.

* * * * *